US006887091B1

(12) United States Patent
Wu

(10) Patent No.: US 6,887,091 B1
(45) Date of Patent: May 3, 2005

(54) CABLE CONNECTOR ASSEMBLY HAVING ADDITIONAL PULL TAB

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/745,825

(22) Filed: Dec. 24, 2003

(51) Int. Cl.[7] ..... H01R 13/627
(52) U.S. Cl. ..... 439/352; 439/357
(58) Field of Search ..... 439/352–357, 439/607, 610

(56) References Cited

U.S. PATENT DOCUMENTS

| | | | | |
|---|---|---|---|---|
| 4,708,413 A | * | 11/1987 | Schroeder | 439/358 |
| 5,197,901 A | * | 3/1993 | Hashiguchi | 439/352 |
| 5,338,227 A | * | 8/1994 | Nakamura | 439/607 |
| 5,564,939 A | | 10/1996 | Maitani et al. | |
| 5,628,648 A | * | 5/1997 | Higgins et al. | 439/489 |
| 5,788,534 A | | 8/1998 | Koegel et al. | |
| 5,820,412 A | | 10/1998 | Koegel et al. | |

* cited by examiner

*Primary Examiner*—Truc Nguyen
(74) *Attorney, Agent, or Firm*—Wei Te Chung

(57) ABSTRACT

A cable connector assembly (100) includes a first and a second cover-halves (1, 2) joined together, a connector module (3), a first pull tab (4) assembled between the first and the second cover-halves, and a second pull tab (7) movably assembled to the first pull tab. The first cover-half forms a mating frame (13) and the connector module includes an insulative housing (301) received in the mating frame, a number of contacts (304), a cable (32) and a printed circuit board (303) electrically connecting with the contacts and the cable. The first pull tab includes a first operating portion (41) and a pair of first arms (42) received between the first and the second cover-halves. The second pull tab includes a second operating portion (71), a pair of second arms (72) extending forwardly from the second operating portion and a cooperating portion (73) interconnecting with the pair of second arms. The second arm is formed with a first stopping section (720) and the cooperating portion is formed with a second stopping section (732). The second pull tab is pushed to engage with the first pull tab at the first stopping section and the second pull tab is pulled to engage with the first pull tab at the second stopping section.

21 Claims, 16 Drawing Sheets

CABLE CONNECTOR ASSEMBLY HAVING ADDITIONAL PULL TAB

CROSS-REFERENCE TO RELATED APPLICATIONS

Relevant subject matter is disclosed in pending U.S. patent application Ser. Nos. 10/210,129 filed on Jul. 31, 2002 and entitled "ELECTRICAL CONNECTOR HAVING A LATCH MECHANISM", Ser. No. 10/245,188 filed on Sep. 16, 2002 and entitled "ELECTRICAL CONNECTOR HAVING IMPROVED PULL TAB", Ser. No. 10/235,290 filed on Sep. 4, 2002 and entitled "ELECTRICAL CONNECTOR HAVING IMPROVED LATCH MECHANISM", and Ser. No. 10/236,597 filed on Sep. 5, 2002 and entitled "ELECTRICAL CONNECTOR HAVING ENGAGING DEVICE", all of which are invented by the same inventor as this patent application and assigned to the same assignee with this application.

BACKGROUND OF THE INVENTION

1. Field of the Invention

The present invention generally relates to a cable connector assembly, and more particularly to a cable connector assembly having an additional pull tab for separating the cable connector assembly from a complementary connector more conveniently.

2. Description of Related Art

It is well known that a cable connector assembly comprises a cable end connector and a cable terminating to the cable end connector. The cable connector assembly electrically connects with a complementary connector to transmit signals from the cable to the complementary connector. The cable connector assembly and the complementary connector are often equipped with interlocking mechanisms to secure two mated connectors together.

U.S. Pat. Nos. 6,589,066, 6,641,425 and 6,648,665 all issued to the same assignee as this application, each disclose a cable connector assembly having a pull tab assembled thereto. The pull tab comprises an operating portion exposed the cable connector assembly and a pair of arms respectively received in a pair of channels defined by a pair of cover-halves of the cable connector assembly. Each arm is engaged with a latch spring for latching with the complementary connector. A pair of metal springs are assembled to inner sides of the arms for latching with a complementary connector. When the pull tab is pulled rearwardly to cause the latch springs deformed, the complementary connector is released. Then the metal spring resumes to an original position thereby push the pull tab to return back to an original position.

This design is convenient to lock and unlock the cable connector assembly and the complementary connector. The cable connector assembly is mounted to a panel on which the complementary connector is usually mounted. However, the panel may have so many components mounted thereon, thus, the space left for an operator to pull the pull tab is very limited. This kind of the cable connector assembly with the pull tab is not suitable for such condition.

Hence, a cable connector assembly with an additional pull tab for being operated conveniently is needed to address the problems encountered in the related art.

SUMMARY OF THE INVENTION

Accordingly, an object of the present invention is to provide a cable connector assembly having an additional pull tab for conveniently separating from a complementary connector.

In order to achieve the objects set forth, a cable connector assembly in accordance with the present invention comprises a first cover-half, a second cover-half assembled to the first cover-half, a connector module assembled between the first and the second cover-halves, a first pull tab assembled between the first and the second cover-halves, a pair of latch springs cooperating with the first pull tab, a pair of metal springs, and a second pull tab movably assembled to the first pull tab. The first cover-half forms a mating frame on a front portion thereof and the connector module comprises an insulative housing received in the mating frame, a plurality of contacts received in the insulative housing, a cable and a printed circuit board electrically connecting with the contacts and the cable. The first pull tab comprises a first operating portion and a pair of first arms extending forwardly from opposite ends of the first operating portion. The second pull tab comprises a second operating portion, a pair of second arms extending forwardly from opposite ends of the second operating portion and a cooperating portion interconnecting with the pair of second arms. The second arm is formed with a first stopping section and the cooperating portion is formed with a second stopping section. The second pull tab is pushed to engage with the first pull tab at the first stopping section and the second pull tab is pulled to engage with the first pull tab at the second stopping section.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
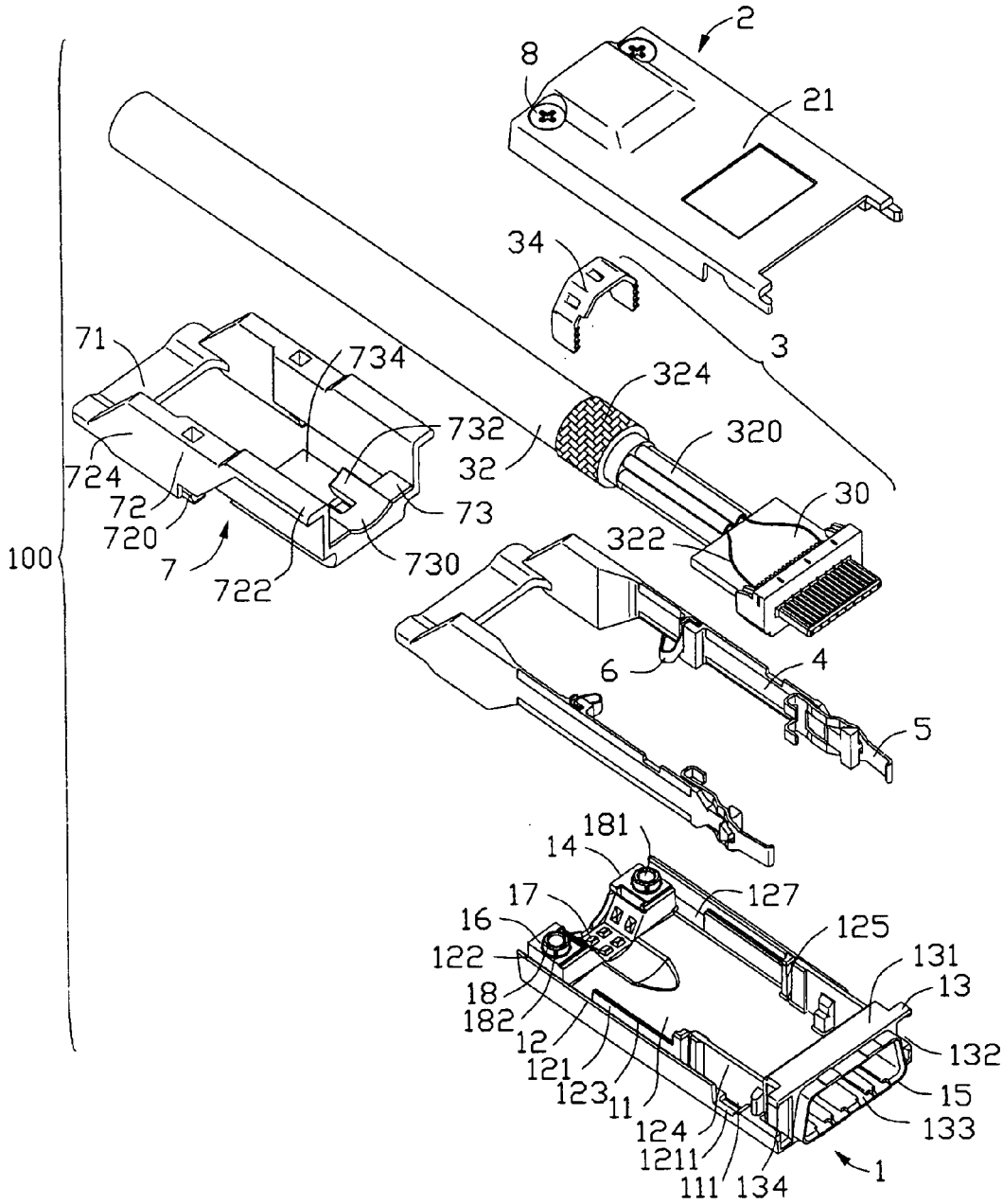
FIG. 1 is a partially exploded, perspective view of a cable connector assembly in accordance with the present invention.

Referring to FIG. 1, a cable connector assembly 100 in accordance with the present invention comprises a cover comprising a first die cast cover-half 1 and a second die cast cover-half 2 joined to the first cover-half 1, a connector module 3, a first pull tab 4, a pair of latch springs 5, a pair of metal springs 6, a second pull tab 7 and a pair of screws 8 for securing the second cover-half 2 to the first cover-half 1.

The first and the second cover-halves 1, 2 are formed by die casting metallic material, for example, aluminum alloy. Referring to FIG. 1, the first cover-half 1 comprises a first base plate 11 and a pair of first sidewalls 12 upwardly extending from opposite lateral sides of the first base plate 11. Each first sidewall 12 defines an elongated first channel 121 from a rear portion 14 toward a front end 15 of the first cover-half 1 and extending through a top engaging face 16 thereof. Each first sidewall 12 is divided into a first outer wall 122 and a first inner wall 123 by the first channel 121. The first inner walls 123 each have a higher shoulder portion 124 adjacent to the front end 15 and define a first cutout 127 adjacent to the rear portion 14. The shoulder portions 124 each define a vertical slit 125 at a rear end thereof. The first outer walls 122 each define a first gap 1211 adjacent to the front end 15. The first base plate 11 defines a pair of first grooves 111 each being located between the shoulder portion 124 of a corresponding first inner wall 123 and a corresponding first gap 1211. A mating frame 13 is formed at the front end 15 of the first cover-half 1. The mating frame 13 defines an opening 133 through the front end 15. A pair of engaging ears 131 is formed on opposite sides of a top of the mating frame 13 and extends laterally. Each engaging ear 131 has a protrusion 134 downwardly extending from a free end thereof. A pair of engaging spaces 132 is defined in opposite sides of the mating frame 13 and between the engaging ears 131 and the base plate 11. The first cover-half 1 has a substantially semicircular first opening 17 at the rear portion 14. A pair of posts 18 protrudes upwardly from the engaging face 16, located respectively at opposite sides of the first opening 17. Each post 18 defines a screw hole 181 therein and has four ribs 182 on a circumferential periphery thereof.

Figure 2:
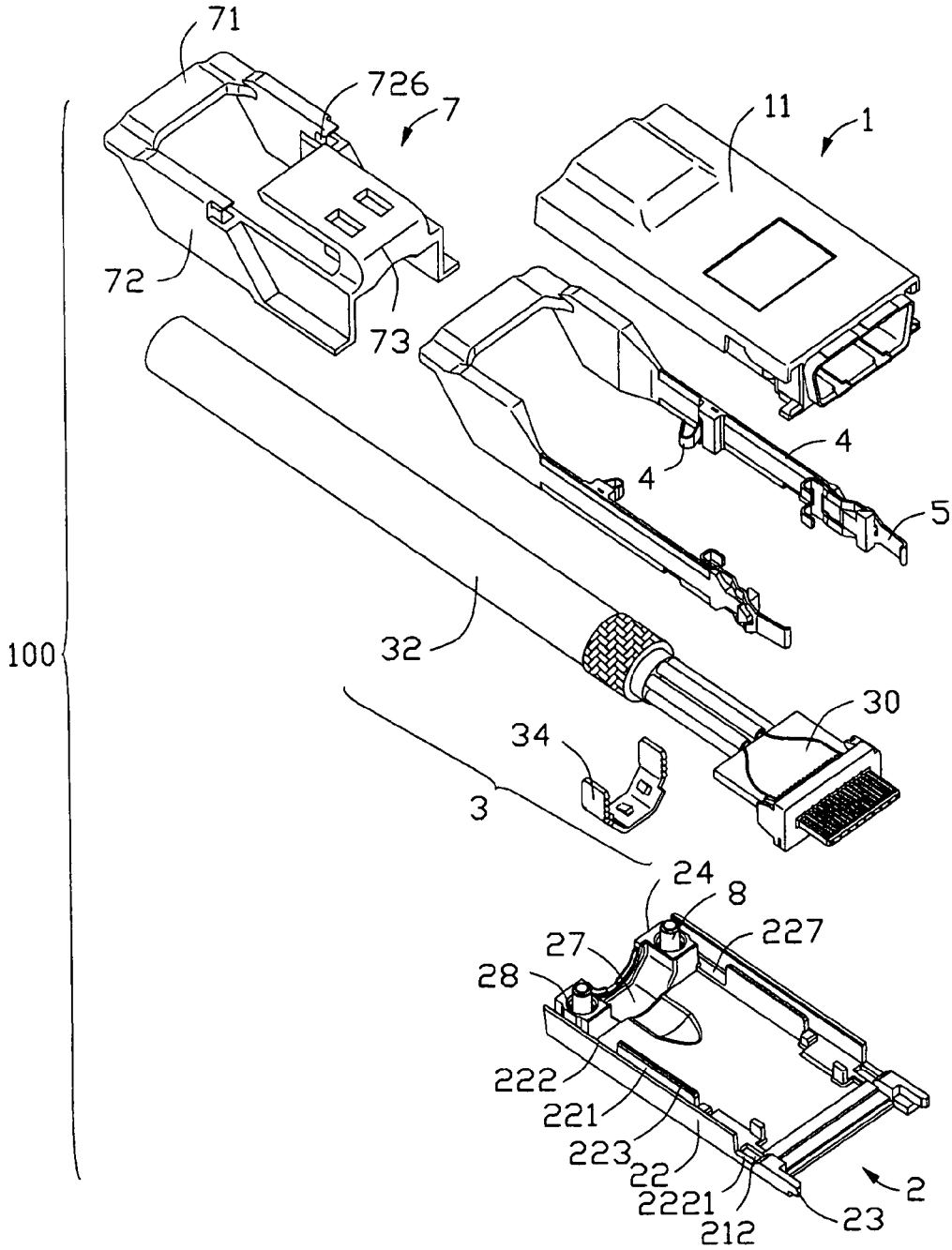
FIGS. 2–4 are views similar to FIG. 1, but taken from different aspects.

Referring to FIG. 2, the second cover-half 2 comprises a second base plate 21 and a pair of second sidewalls 22 downwardly extending form opposite lateral sides of the second base plate 21. Each second sidewall 22 defines an elongated second channel 221 corresponding to the first channel 121 of the first cover-half 1. Each second sidewall 22 is divided into a second outer wall 222 and a second inner wall 223 by the second channel 221. Each second inner wall 223 defines a second cutout 227 adjacent to a rear end 24 corresponding to the first cutout 127 of the first cover-half 1. A pair of second grooves 212, corresponding to the first grooves 111 in the first cover-half 1, is defined in the second base plate 21 in inner sides of a pair of second gaps 2221 which is corresponding to the first gaps 1211 in the first cover-half 1. A pair of projections 23 extends forwardly from opposite sides of a front end of the second base plate 21. A semicircular second opening 27 is defined in the rear end 24 of the second base plate 21 corresponding to the first opening 17 of the first cover-half 1. A pair of holes 28 is defined in the rear end 24, locating at opposite sides of the second opening 27. Each hole 28 has a diameter generally equal to an outer diameter of each of the posts 18.

Figure 3:
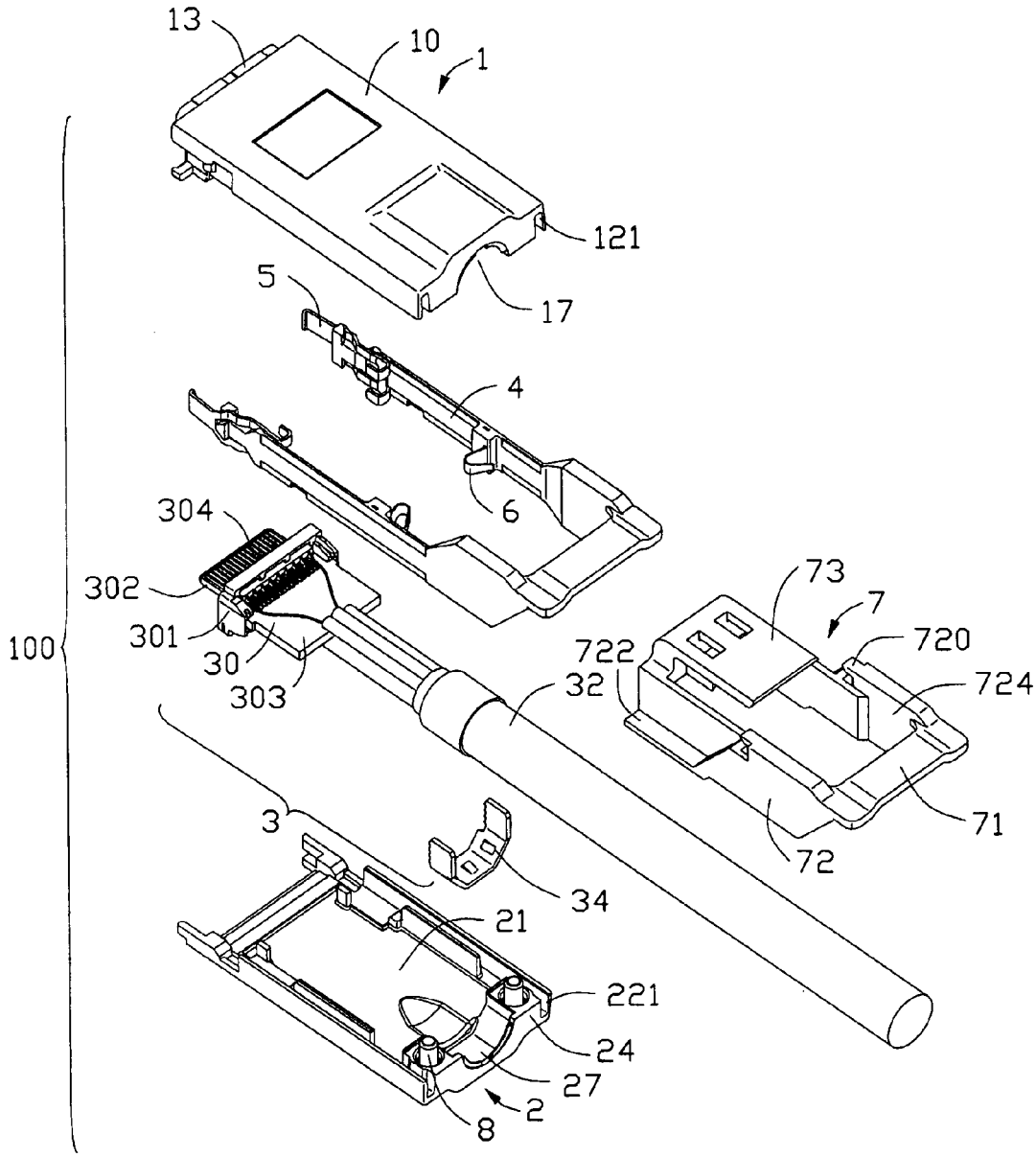
Figure 4:
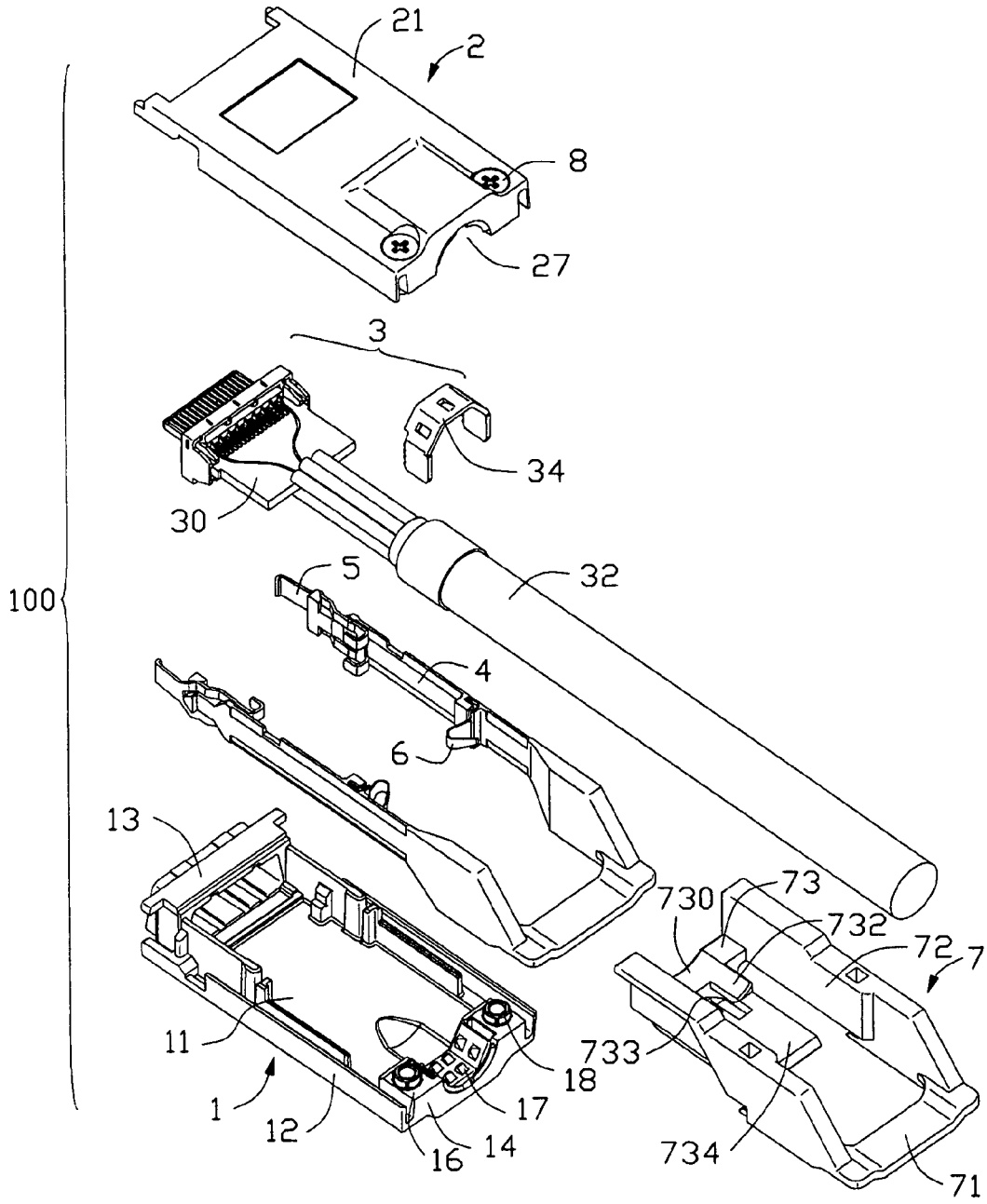

Referring to FIG. 3, the connector module 3 comprises a contact module 30, a cable 32 terminated to the contact module 30 and a strain relief 34 assembled to the cable 32. The contact module 30 comprises an insulative housing 301, a tongue portion 302 extending forwardly from the housing 301, a printed circuit board (PCB) 303 assembled to the housing 301 at a rear side thereof. A plurality of contacts 304 is received in the tongue portion 302 and extends through the housing 301 to electrically connect the PCB 303. The cable 32 comprises a plurality of insulated wires 320 partially exposed beyond a front end of the cable 32. The front end of the cable 32 is partially stripped to expose a metal braiding 324 thereof. Each wire 320 comprises at least one conductor 322 electrically connecting with the PCB 303, and thus, electrically connecting with the corresponding contact 304. The strain relief 34 is typically made of electrical conductive material with high rigidity. The strain relief 34 encloses a circumference of the metal braiding 324 for providing strain relief to the cable 32.

Figure 5:
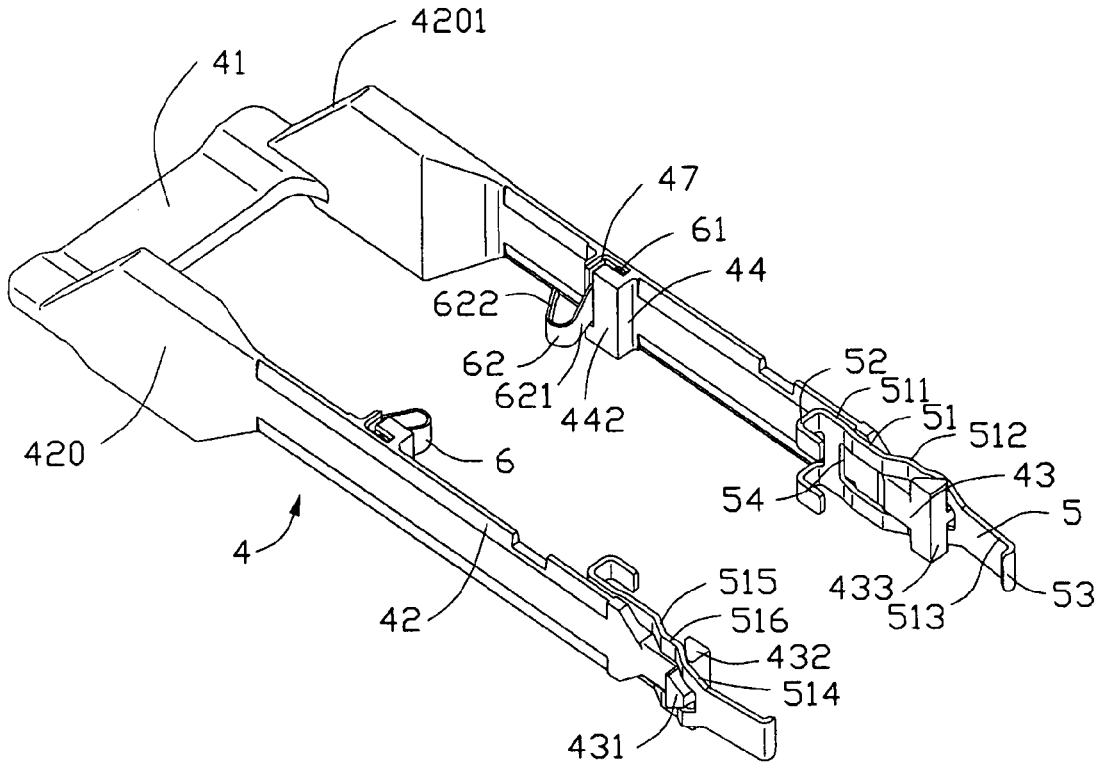
FIG. 5 is an enlarged view of a first pull tab of the cable connector assembly with a pair of latch springs and a pair of metal springs assembled thereon.
Figure 6:
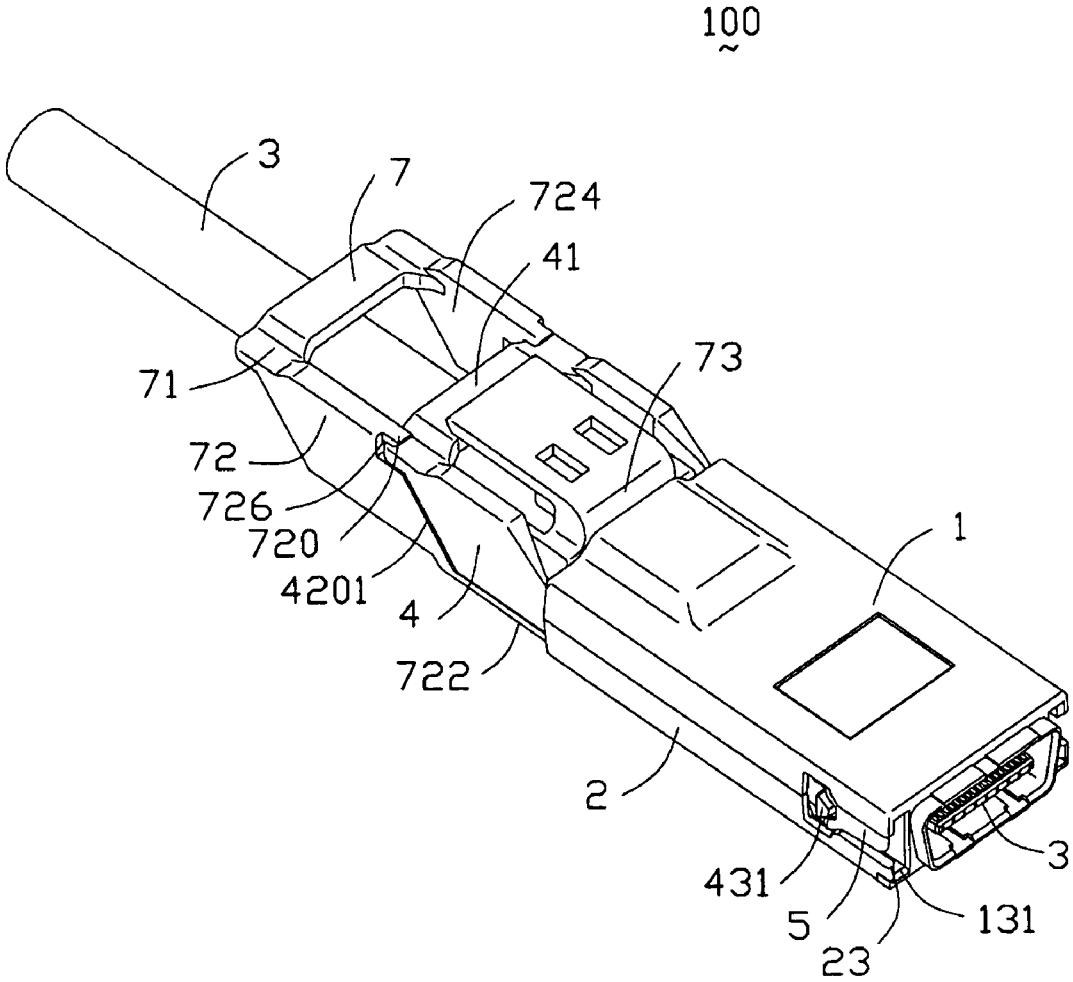
FIG. 6 is an assembled view of FIG. 1.
Figure 7:
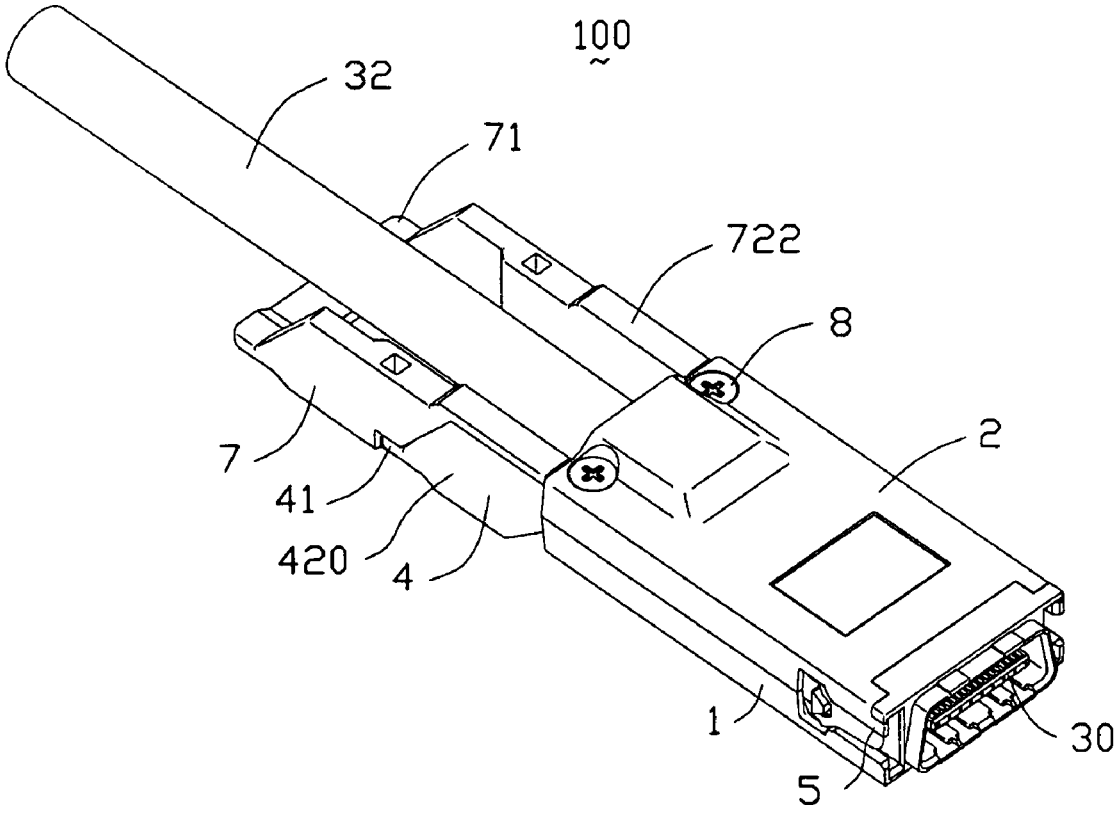
FIGS. 7–9 are views similar to FIG. 6, but taken from different aspects.
Figure 8:
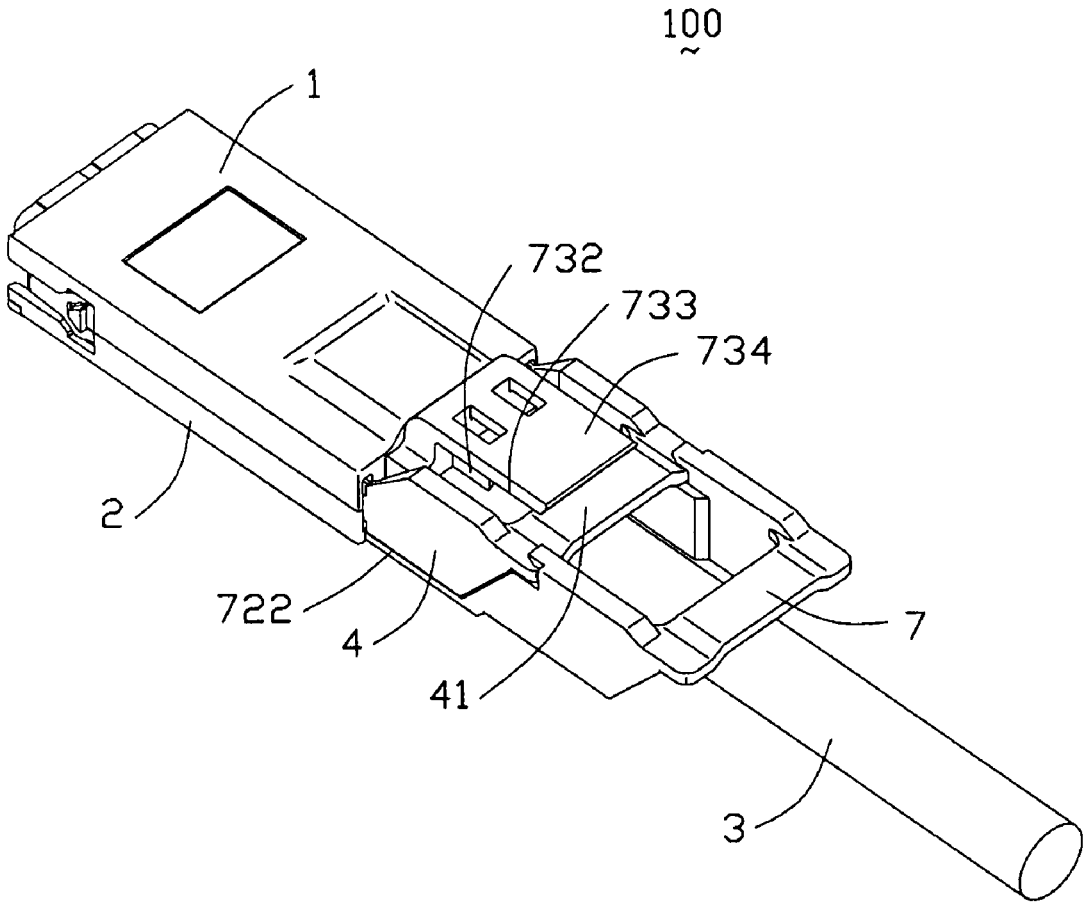
Figure 9:
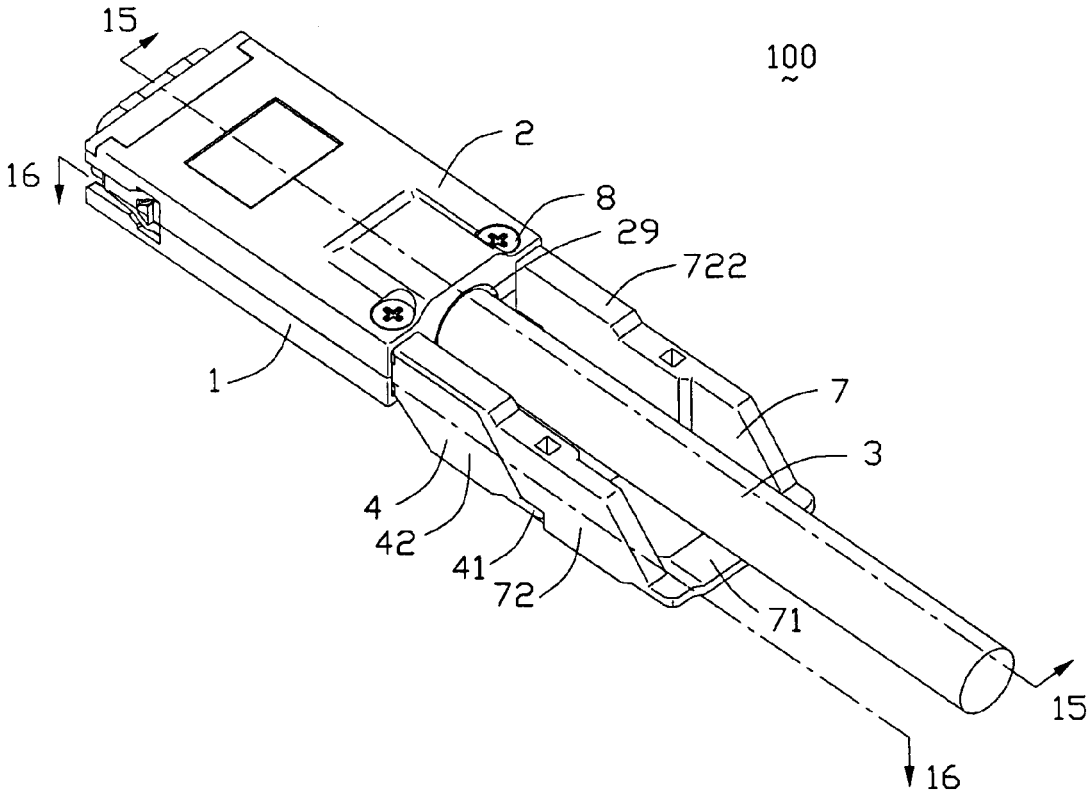
Figure 10:
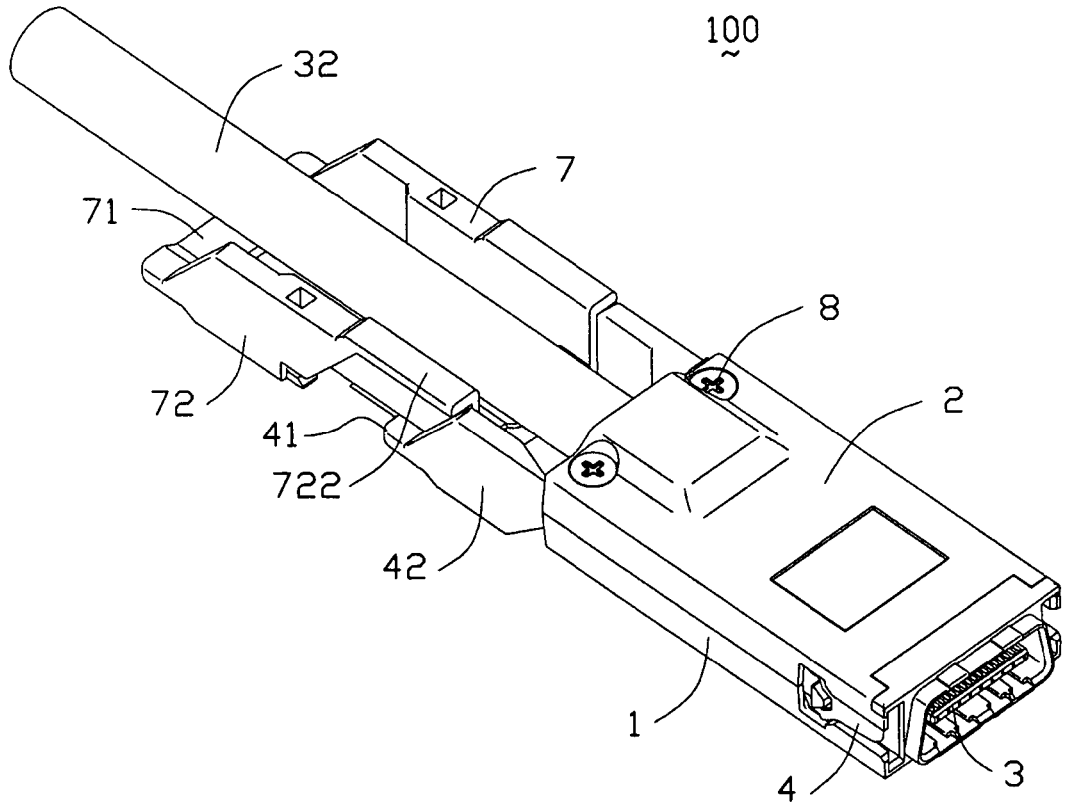
FIG. 10 is also an assembled view of FIG. 1 with a second pull tab thereof in a loosen position.
Figure 11:
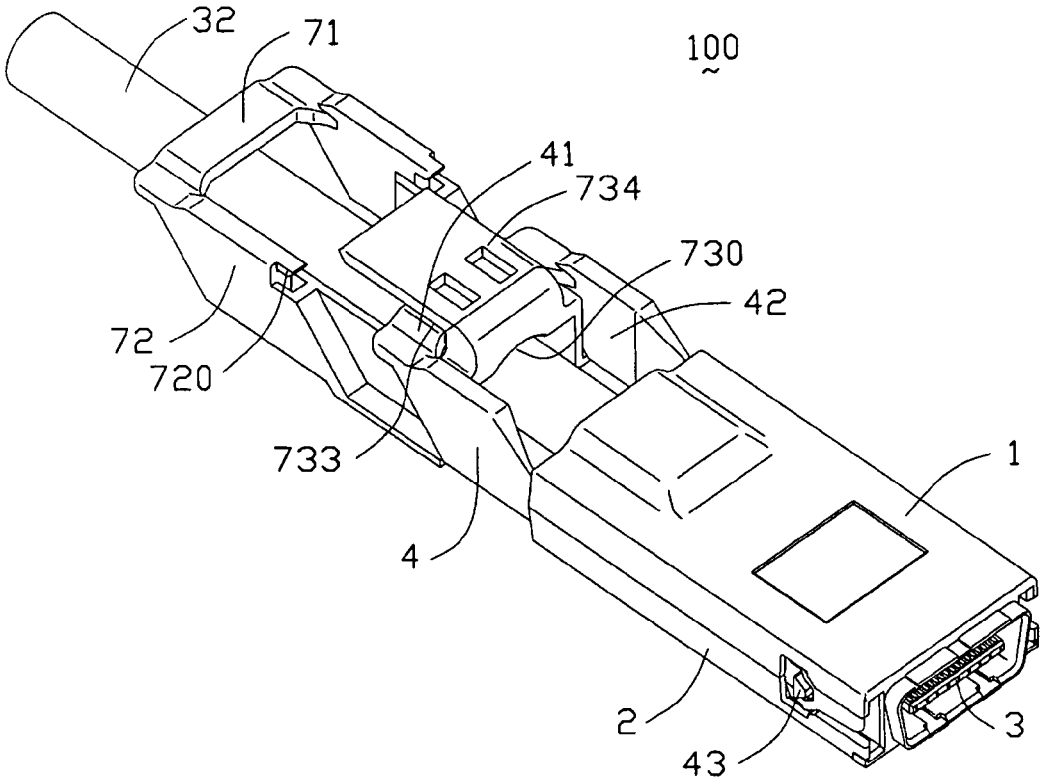
FIGS. 11–13 are views similar to FIG. 10, but taken from different aspects.
Figure 12:
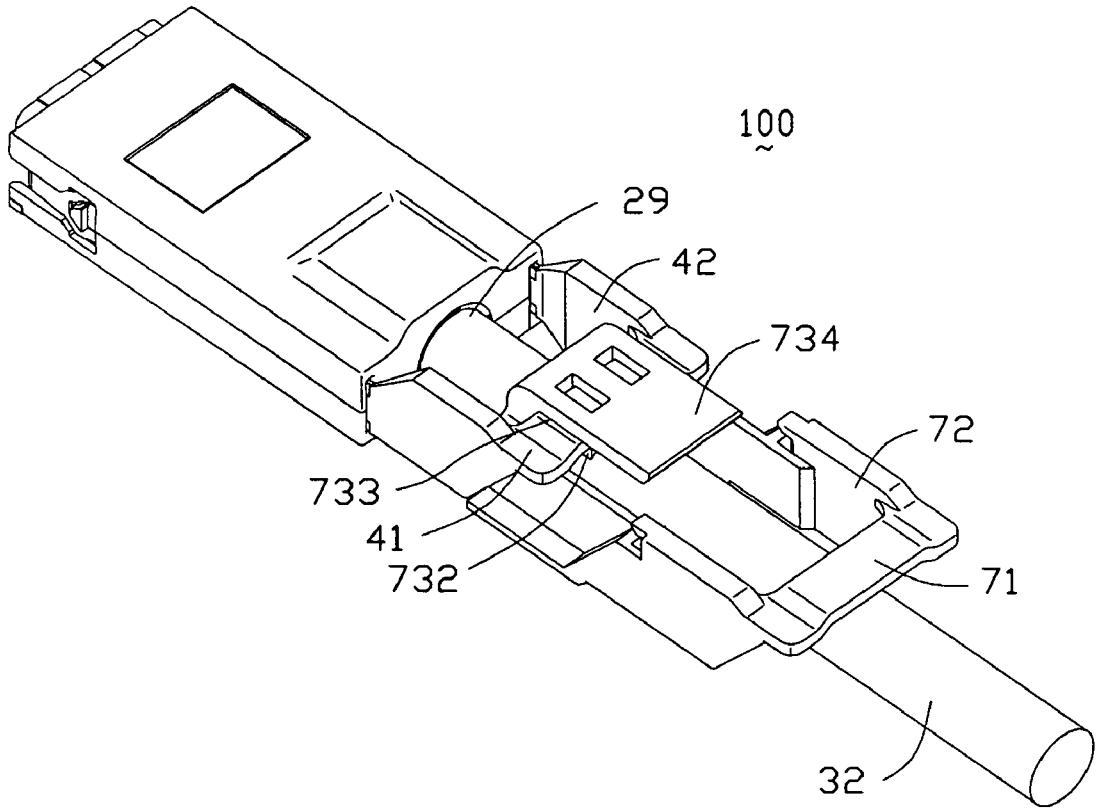
Figure 13:
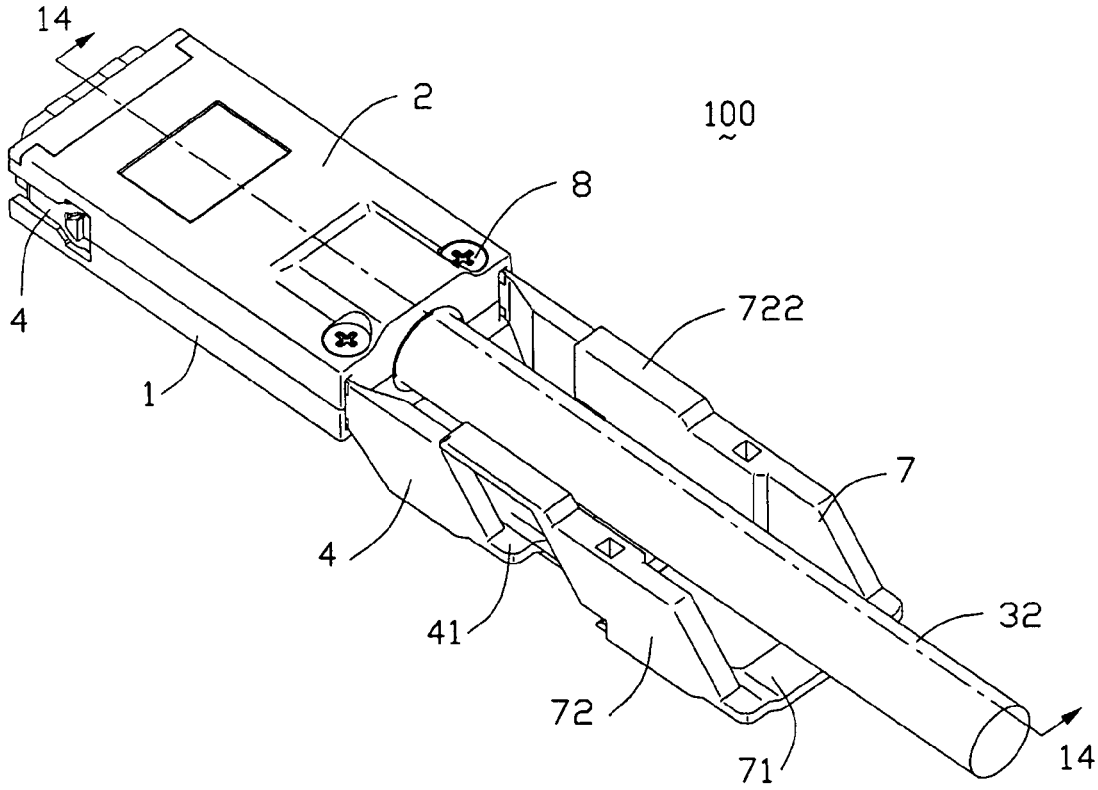

Particularly referring to FIG. 5, the first pull tab 4 comprises a first operating portion 41, a pair of first arms 42 extending forwardly from opposite sides of the first operating portion 41, and a pair of latch releasing portions 43 formed at front ends of the arms 42, respectively. Each latch releasing portion 43 has upper and lower tip ends 432, 433 and an extrusion 431 protruding outwardly from an outside face thereof. Each first am 42 comprises a first enlarged arm section 420 formed with an inclined guiding surface 4201. Each first arm 42 also comprises a block 44 formed on an inner side thereof. A pair of L-shaped slits 47 is defined in the blocks 44 from inner faces 442 of the blocks 44 to the arms 42.

Each latch spring 5 is formed by stamping a metal sheet and has a body portion 51, a U-shaped first claw portion 52 formed at a rear end of the body portion 51 and an L-shaped second claw portion 53 formed at a front end of the body portion 51. An elongated cutout 54 is defined in the body portion 51 in a front-to-rear direction. The body portion 51 comprises a rear portion 511, a middle portion 512 and a front portion 513 extending inwardly from the middle portion 512. The middle portion 512 comprises a front slope portion 514, a rear slope portion 515 and an intermediate portion 516 interconnecting the front and the rear slope portions 514, 515.

Each metal spring 6 comprises a retaining portion 61 and a U-shaped spring portion 62 extending from the retaining portion 61. The spring portion 62 has a first section 621 perpendicularly extending from the retaining portion 61 and a second section 622 extending from the first section 621 and bent toward the retaining portion 61.

The pair of latch springs 5 are respectively assembled to the first pull tab 4 by extending the extrusions 431 into the cutouts 54 from inner faces of the latch springs 5, whereby the latch releasing portions 43 engage with the inner faces of the latch springs 5, respectively. The latch releasing portions 43 are positioned at inner sides of the front portions 513. The metal springs 6 are assembled to the first pull tab 4 with the retaining portions 61 received in the slits 47.

Referring to FIGS. 1–4, the second pull tab 7, which functions as an actuator/stop for moving/blocking the first pull tab 4, has a substantially similar figure as that of the first pull tab 4 and comprises a second operating portion 71, a pair of second arms 72 extending forwardly from opposite ends of the second operating portion 71 and a cooperating portion 73 formed between the pair of second arms 72. Each second arm 72 comprises a second enlarged arm section 724 adjacent to the second operating portion 71 and an L-shaped arm section 722 adjacent to the cooperating portion 73. A first stopping section 720 is formed integrally at a lower surface of the second enlarged arm section 724 and a first receiving space 726 is, thus, formed between the first stopping section 720 and the second enlarged arm section 724. The cooperating portion 723 comprises a transverse section 730 connecting with the pair of L-shaped arm sections 722, a pair of second stopping sections 732 extending rearwardly from a top surface of the transverse section 730 and a plate section 734 extending rearwardly from a bottom surface of the transverse section 730. A second receiving space 733 is formed by the pair of second stopping sections 732, the transverse section 730 and the plate section 734.

Figure 14:
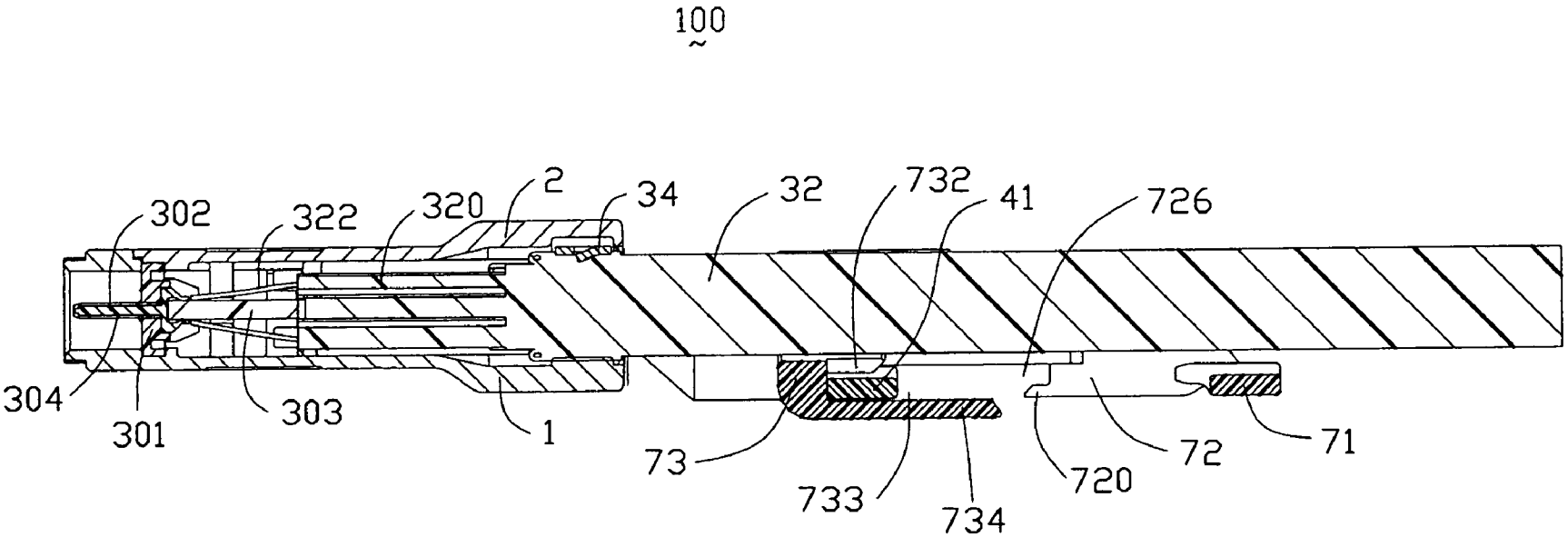
FIG. 14 is a cross-sectional view of the cable connector assembly taken along line 14—14 of FIG. 13.
Figure 15:
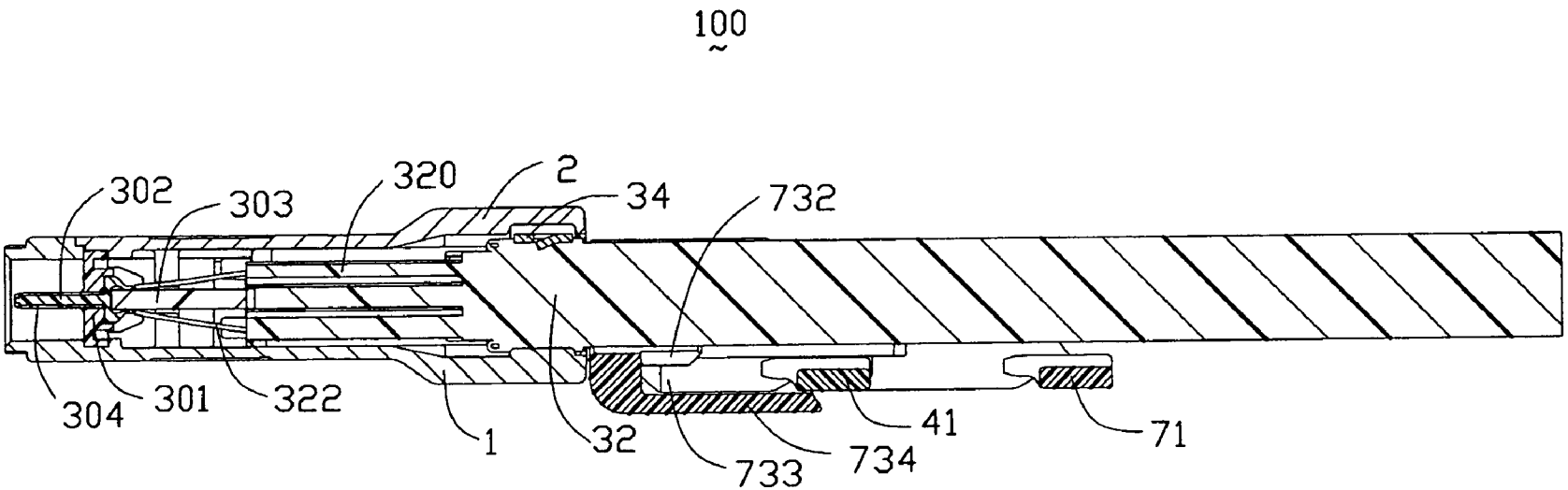
FIG. 15 is a cross-sectional view of the cable connector assembly taken along line 15—15 of FIG. 9.
Figure 16:
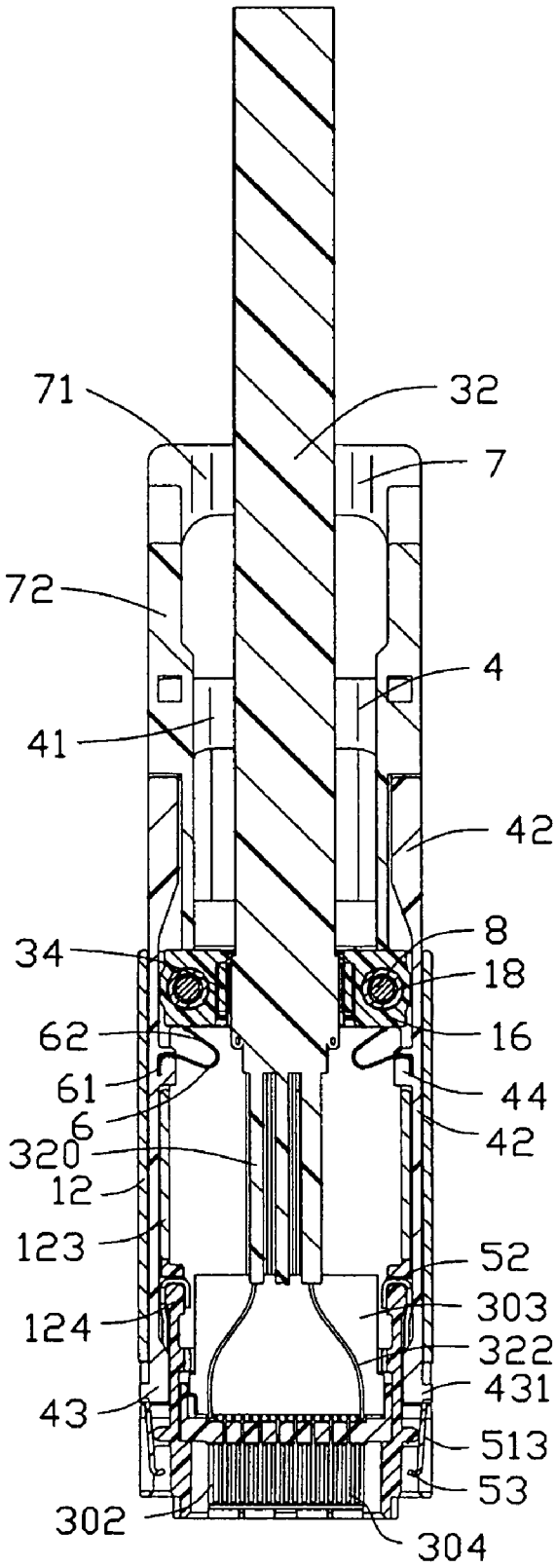
FIG. 16 is a cross-sectional view of the cable connector assembly taken along line 16—16 of FIG. 9.

In assembly, referring to FIGS. 6–9 in conjunction with FIGS. 14–16, the connector module 3 is assembled to the first cover-half 1 with the tongue portion 302 received into the opening 133. The PCB 303 is received in the first cover-half 1 between the two sidewalls 12. The cable 32 with the strain relief 34 is received in the first opening 17 of the first cover-half 1. The first pull tab 4 with the latch springs 5 and the metal springs 6 is first assembled to the second pull tab 7 with the first operating portion 41 partially received in the first receiving space 726 and secured between L-shaped arm section 722 and the first stopping section 720 of the second pull tab 7. Then the first and the second pull tabs 4, 7 with the latch springs and the metal springs 6 are together assembled to the first cover-half 1. The first arms 42 are placed into the first channels 121 with the first operating portion 41 located outside of the rear portion 14 of the first cover-half 1. The blocks 44 are positioned in the first cutouts 127 and the second sections 622 of the spring portions 62 abut against the rear portion 14 of first cover-half 1. The U-shaped first claw portions 52 are received into the slits 125 and engage with the shoulder portions 124 to secure the latch springs 5 to the first cover-half 1. The L-shaped second claw portions 53 extend into the engaging spaces 132. The lower tip ends 433 of the latch releasing portions 43 are placed in the first grooves 111 with the extrusions 431 extending into the first gaps 1211.

The second cover-half 2 is assembled to the first cover-half 1 by placing the projections 23 beneath under the pair of engaging ears 131. The rear end 24 of the second cover-half 2 is rotated downwardly about the pair of engaging ears 131 until a bottom face of the second cover-half 2 intimately abuts against the engaging face 16 of the first cover-half 1. Upper portions of the arms 42 are received in the second channels 221, the upper tip ends 432 of the latch releasing portions 43 are received into the second grooves 212 of the second cover-half 2, and upper portions of the blocks 44 positioned in the second cutouts 227. The posts 18 are received into the holes 28 with the four ribs 182 engaging with inner surfaces of the holes 28. The first and the second openings 17, 27 together form a cable receiving opening 29 (FIG. 9) for extension of the cable 32 therethrough. The pair of screws 8 are screwed into the screw holes 181 to securely fasten the first and the second cover-halves 1, 2 together.

Referring to FIGS. 6–13 in conjunction with FIGS. 14–16, an operation between the cable connector assembly 1 and the complementary connector is introduced below.

Firstly referring to FIGS. 6–9 in conjunction with FIGS. 15–16, before the cable connector assembly 100 in accordance with the present invention is to be mated with the complementary connector, an operator needs to push the second pull tab 7 toward the first pull tab 4. The L-shaped arm sections 722 of the second pull tab 7 slide along the inclined guiding surfaces 4201 of the first pull tab 4 until the first operating portion 41 is received in the first receiving space 726. Thus, the second pull tab 7 engages with the first pull tab 4 at a first position thereof. The L-shaped arm sections 722 and the plate section 734 can prevent the second pull tab 7 from moving along a direction perpendicular to the extension direction of the cable 32. Then the operator pushes the second operating portion 71 of the second pull tab 7 to cause the cable connector assembly 100 to move toward and mate with the complementary connector with the L-shaped second claw portions 53 clamping corresponding engaging portions of the complementary connector. When pushing, the first stopping section 720 can prevent the second pull tab 7 from rotating relative to the first pull tab 4.

Referring to FIGS. 10–13 in conjunction with FIGS. 14–16, the cable connector assembly 100 is unmated with the complementary connector by the following operation. The operator pulls the second operating portion 71 of the second pull tab 7 rearwardly, firstly the second pull tab 7 moves rearwardly relative to the first pull tab 4 until the first operating portion 41 of the first pull tab 4 is received in the second receiving space 733 of the second pull tab 7. Thus, the second pull tab 7 engages with the first pull tab 4 at a second position thereof. Then the first pull tab 4 is pulled by the second pull tab 7, whereby the upper and the lower tip ends 432, 433 slide in the first and the second grooves 111, 212 and the protrusions 431 slide in the cutouts 54. When the latch releasing portions 43 come into contact with the front slope portions 514, an outward force is exerted on inner faces of the front slope portions 714 by the pair of latch releasing portions 43. The latch spring 5 is elastically deformed and the front portion 513 is pushed out, whereby the L-shaped second claw portions 53 are driven to move out of the engaging portions of the complementary connector. When the latch releasing portions 43 slide on the intermediate portions 516, the intermediate portions 516 exert an inward force on the latch releasing portions 43. In the same time, the metal springs 6 are elastically deformed to a deflective position and transmit a pull force to the cable connector assembly 100 and the whole cable connector assembly 100 is pulled out of the complementary connector.

When the pulling force acting on the second pull tab 7 is released, the metal spring 6 resumes to its original position, thereby pushes the first pull tab 4 to return back to original position. At the same time, the latch releasing portions 43 return to contact the front slope portions 516, the latch springs 5 resume to the original position by a spring force itself. The second pull tab 7 can be pushed toward the first pull tab 4 as described above to reduce the total length of the cable connector assembly 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a first cover-half having a mating frame on a front portion thereof;

a second cover-half assembled to the first cover-half;

a connector module assembled between the first and the second cover-halves and comprising an insulative housing received in the mating frame, a plurality of contacts received in the insulative housing and a cable electrically terminating with the contacts;

a first pull tab comprising a first operating portion and a pair of first arms movably assembled between the first and the second cover-halves;

a pair of latch springs cooperating with the pair of first arms of the first pull tab for engaging with corresponding portions of a complementary connector; and a second pull tab movably assembled to the first pull tab, the second pull tab being pushed to engage with the first pull tab at a first position where the latch springs engage with the complementary connector and the second pull tab being pulled to engage with the first pull tab at a second position where the first pull tab moves therewith and the latch springs disengage from the complementary connector.

2. The cable connector assembly as claimed in claim 1, wherein the second pull tab comprises a second operating portion, a pair of second arms extending from the second operating portion in an extension direction of the cable and a cooperating portion formed between the pair of second arms, and wherein the first operating portion of the first pull tab engages with the second arms of the second pull tab at the first position and engages with the cooperating portion at the second position.

3. The cable connector assembly as claimed in claim 2, wherein the second arm of the second pull tab forms a first stopping section, and wherein the first operating portion of the first pull tab is secured by the first stopping section at the first position.

4. The cable connector assembly as claimed in claim 3, wherein the second arm of the second pull tab comprises an enlarged arm section adjacent to the second operating portion and an L-shaped arm section adjacent to the cooperating portion, and wherein the first stopping section is formed integrally with the enlarged arm section.

5. The cable connector assembly as claimed in claim 2, wherein the cooperating portion of the second pull tab forms a transverse section connecting with the second arms, a plate section extending toward the second operating portion from the transverse section and a second stopping section facing to the plate section, and wherein the first pull tab is secured between the plate section and the second stopping section in the second position.

6. The cable connector assembly as claimed in claim 1, wherein the first arms of the first pull tab respectively press on the L-shaped arm sections of the second pull tab as the first and the second pull tabs engage with each other at the first position.

7. The cable connector assembly as claimed in claim 1, further comprising a pair of metal springs assembled to the pair of first arms of the first pull tab, and wherein the second pull tab is pulled to engage with the first pull tab at the second position with the metal springs elastically deformed and the metal springs resume to an original position with the pulling force exerted on the second pull tab released.

8. The cable connector assembly as claimed in claim 7, wherein each metal spring comprises a retaining portion assembled to the arm and a spring portion extending from the retaining portion.

9. The cable connector assembly as claimed in claim 8, wherein each first arm of the first pull tab forms a block on an inner side thereof, and wherein each block defines a slit to receive a corresponding retaining portion of the metal spring.

10. The cable connector assembly as claimed in claim 8, wherein each spring portion of the metal spring has a first section extending from the retaining portion along a direction perpendicular to the retaining portion and a second section extending from the first section and bent toward the retaining portion.

11. The cable connector assembly as claimed in claim 1, wherein the first and the second cover-halves respectively define a pair of first and second channels on opposite sides thereof, and wherein the first arms of the first pull tab are respectively received in each pair of first and second channels.

12. The cable connector assembly as claimed in claim 1, each latch spring has a first claw portion engaging with the first cover-half, a second claw portion adapted for engaging with the complementary connector, and a body portion formed between the first and the second claw portions, and wherein each first arm forms a latch releasing portion engaging with a corresponding body portion of the latch spring.

13. The cable connector assembly as claimed in claim 12, wherein the body portions are pushed by the latch releasing portions to deflect outwardly to actuate the second claw portions to move outwardly and disengage from the complementary connector.

14. The cable connector assembly as claimed in claim 1, wherein the connector module further comprises a printed circuit board electrically connecting with the contacts and the cable.

15. The cable connector assembly as claimed in claim 1, wherein the first and the second cover-halves are made of metallic material.

16. A cable connector assembly comprising:

a cover device;

a connector module disposed in the cover and including an insulative housing with a plurality of contacts therein;

front portions of the contacts defining a mating port around a mating side of the cover device;

a cable electrically connected to rear portions of the contacts;

a pair of latches disposed on two lateral sides of the cover device;

a pull tab assembled to the cover device and moveable relative to the cover device along a front-to-back direction, said pull tab including an operation portion around another side of the cover device and a pair of engaging portions respectively engaged with the corresponding latches so as to allow the latches to be laterally moved to be in an unlatched position when said pull tab is moved in said front-to-back direction; and an actuator mounted to at least one of said pull tab or the cover device and including an actuation portion which is moveable to be in a first position to be engaged with the operation portion of the pull tab to actuate said pull tab to move in said front-to-back direction for moving said latches correspondingly.

17. The assembly as claimed in claim 16, wherein said actuator further includes a section to be engaged with the pull tab when said actuator is located in a second position so as to prevent inadvertent movement of the pull tab for assuring the latches to be in a latch position constantly.

18. The assembly as claimed in claim 16, wherein said actuator is moveable along said front-to-back direction.

19. The assembly as claimed in claim 16, wherein said pull tab is generally located between said cover device and said actuator.

20. A cable connector assembly comprising:

a cover device;

a connector module disposed in the cover and including an insulative housing with a plurality of contacts therein;

front portions of the contacts defining a mating port around a mating side of the cover device;

a cable electrically connected to rear portions of the contacts;

a pair of latches disposed on two lateral sides of the cover device;

a delatching tab assembled to the cover device and moveable relative to the cover device along a first direction, said delatching tab including an operation portion around another side of the cover device and a pair of engaging portions respectively engaged with the corresponding latches so as to allow the latches to be moved in a second direction, which is different from said first direction, to be in an unlatched position when said delatching tab is moved in said first direction; and an actuator mounted to at least one of said delatching tab or the cover device and moved with an initial distance from a first position to a second position before substantially actuating said delatching tab to move along said first direction for delatching said latches correspondingly.

21. The assembly as claimed in claim 20, wherein said actuator is moved along said first direction.

* * * * *